US009903087B2

(12) United States Patent
Foster et al.

(10) Patent No.: US 9,903,087 B2
(45) Date of Patent: Feb. 27, 2018

(54) GROUND ENGAGING SHAFT

(71) Applicant: Peter Glen Sutherland, Black Diamond (CA)

(72) Inventors: Clayton Leigh Foster, Millarville (CA); Peter Glen Sutherland, Black Diamond (CA)

(73) Assignee: Peter Glen Sutherland, Black Diamond (CA)

( * ) Notice: Subject to any disclaimer, the term of this patent is extended or adjusted under 35 U.S.C. 154(b) by 0 days.

(21) Appl. No.: 14/428,483

(22) PCT Filed: Sep. 4, 2013

(86) PCT No.: PCT/CA2013/050680

§ 371 (c)(1),
(2) Date: Mar. 16, 2015

(87) PCT Pub. No.: WO2014/040183

PCT Pub. Date: Mar. 20, 2014

(65) Prior Publication Data

US 2015/0275463 A1 Oct. 1, 2015

Related U.S. Application Data

(63) Continuation of application No. 13/619,725, filed on Sep. 14, 2012, now abandoned.

(51) Int. Cl.
*E02D 29/00* (2006.01)
*E02D 29/02* (2006.01)
(Continued)

(52) U.S. Cl.
CPC ..... *E02D 29/02* (2013.01); *E02D 5/56* (2013.01); *E02D 7/22* (2013.01); *E02D 29/00* (2013.01)

(58) Field of Classification Search
CPC .. E02D 29/02; E02D 5/56; E02D 7/22; E02D 29/00; E02D 5/801; E02D 5/80;
(Continued)

(56) References Cited

U.S. PATENT DOCUMENTS 3,584,465 A 6/1971 Holl
3,858,399 A 1/1975 Krings
(Continued)

FOREIGN PATENT DOCUMENTS

CA 1297259 3/1992
CA 2213871 2/1999
(Continued)

*Primary Examiner* — Carib A Oquendo
(74) *Attorney, Agent, or Firm* — Wilmer Cutler Pickering Hale and Dorr LLP

(57) ABSTRACT

An apparatus and method for engaging a member within a soil formation. The apparatus comprises a shaft extending between top and bottom ends along a central axis and having at least one auger section therearound and a first plate, axially rotatably connected to the shaft. The apparatus may further comprise a second plate rotatably connected to the shaft above the first plate which may have connectors for engagement with a corresponding adjacent plate. The method comprises locating the shaft above a soil formation and rotating the shaft into the soil formation so as to draw the first plate into the soil formation.

14 Claims, 7 Drawing Sheets

(51) Int. Cl.
*E02D 5/56* (2006.01)
*E02D 7/22* (2006.01)

(58) Field of Classification Search
CPC .... E02D 5/16; E02D 5/52; E02D 5/54; E02D 5/48; E02D 7/00; E04H 12/2223; E04H 12/223; E04H 12/2215
See application file for complete search history.

(56) References Cited

U.S. PATENT DOCUMENTS

| | | | | |
|---|---|---|---|---|
| 3,938,344 | A | 2/1976 | Asayama | |
| 3,999,392 | A | 12/1976 | Fukishima et al. | |
| 4,091,626 | A | 5/1978 | Thompson | |
| 4,850,565 | A | 7/1989 | Moreno | |
| 5,213,448 | A | 5/1993 | Seider et al. | |
| 5,899,030 | A * | 5/1999 | Barefield | E02D 5/80 403/374.1 |
| 6,142,710 | A | 11/2000 | Holland, Jr. et al. | |
| 6,234,720 | B1 | 5/2001 | Queen et al. | |
| 6,263,622 | B1 | 7/2001 | Griffin et al. | |
| 6,443,664 | B1 * | 9/2002 | Horan | E02D 5/08 405/278 |
| 7,094,003 | B2 | 8/2006 | Faires et al. | |
| 7,241,079 | B2 | 7/2007 | Francis | |
| 7,470,090 | B2 | 12/2008 | Heppner | |
| 7,607,865 | B2 | 10/2009 | Gregory et al. | |
| 7,744,316 | B2 | 6/2010 | Kaufman | |
| 2010/0300017 | A1 | 12/2010 | Bulloch | |

FOREIGN PATENT DOCUMENTS

| | | |
|---|---|---|
| CA | 2497291 | 11/2004 |
| CA | 2711714 | 2/2011 |
| EP | 1348812 | 1/2003 |
| EP | 1541770 | 6/2005 |
| GB | 2420581 | 5/2006 |
| JP | 200054378 | 2/2000 |
| JP | 2000136532 | 5/2000 |
| WO | 9914441 | 3/1999 |
| WO | 2010/093080 | 8/2010 |

* cited by examiner

GROUND ENGAGING SHAFT

BACKGROUND OF THE DISCLOSURE

1. Field of Disclosure

The present disclosure relates to construction in general and in particular to a method and apparatus for engaging a member within a soil formation.

2. Description of Related Art

At many worksites, it is frequently necessary to engage a construction member within the ground for the purposes of securing the member therein or to reinforce or retain a portion of the ground behind the member. Such members may commonly be located within the soil formation by pile driving wherein the member is forcibly pressed into the ground by a backhoe, pile driver or the like. One example of when such methods may be utilized is for locating pilings within the ground.

One disadvantage of such methods is that the force required to drive such a member into the ground can be high requiring relatively large equipment or relatively small members to effectively penetrate the ground. It will be appreciated that such limitations often limit the size of ground penetrating members that may be used in some locations where larger equipment is not able to access.

Another common method of locating the member within the soil formation is to excavate the location where the member is to be located and thereafter backfilling against the member. In particular, one situation in which such methods are used is where it is necessary to excavate a hole to access a buried structure or to expose a location where the work is to occur. In many instances, it is not practical to excavate a large amount of soil due to the proximity of other structures or time constraints. In such circumstances, it is common to excavate a relatively narrow hole or trench and provide reinforcement or shoring to the trench or hole walls to prevent their collapse.

Conventional shoring methods have been to provide timbers or metal plates braced against opposing sides of the trench or hole or braced to a bottom of the hole or trench. Such conventional shoring has several disadvantages. In particular, shoring using a plurality of timbers may be time consuming and inaccurate to install as each timber must be located individually. Furthermore, after the timers are located, they must be secured to each other and thereafter braced against an opposite wall. These multiple steps increase the amount of time required to shore the excavation.

Other methods have been to provide a shoring structure comprising a pair of spaced apart steel plates having a plurality of struts therebetween. Disadvantageously, such shoring structures are also required to either be assembled within the excavation or pre-assembled and lowered into the excavation as a whole. Where the assembled structure is lowered into the excavation as a whole, it may be possible for the shoring structure to partially collapse or otherwise impact and thereby disturb the excavation wall.

An additional difficulty with current excavation shoring methods, is that it is necessary to excavate the location before the shoring is put into place. In many soil types, such as, for example, moist or soft soils, such unshored excavations may be prone to wall collapse before the shoring can be properly located. The struts and other bracing members between shoring walls may also limit the access that workers and equipment has to the bottom of the shored excavation.

SUMMARY OF THE DISCLOSURE

According to a first embodiment of the present disclosure there is disclosed an apparatus for engaging a soil formation comprising a shaft extending between top and bottom ends along a central axis and having at least one auger section therearound and a first plate, axially rotatably connected to the shaft.

The at least one auger section may be proximate to the bottom end of the shaft. The shaft may include a second auger section located below the first plate.

The first plate may be located proximate to the top end of the shaft. The first plate may be located at substantially a midpoint of the shaft. The first plate may be longitudinally located along the shaft. The first plate may be longitudinally located along the shaft by collars. The first plate may extend substantially radially from the shaft. The first plate may include a top edge extending substantially perpendicularly from an axis of the shaft. The plate may include a bottom edge extending at an angle of incline from a plane normal to the axis of the shaft.

The apparatus may further comprise a second plate rotatably connected to the shaft above the first plate. The second plate may be substantially alignable with the first plate. The second plate may be independently rotatable of the first plate. The second plate may extend between first and second side edges. The first and second side edges may be substantially parallel with the central axis. The first and second side edges may have connectors for engagement with a corresponding adjacent plate. The connectors may comprise a u-shaped channel adapted to intermesh with corresponding u-shaped channel of adjacent plates so as to be interlocked therewith.

Each u-shaped channel may comprise a flange extending from each of the first and second side edges to a parallel spaced apart end plate.

According to a further embodiment of the present disclosure there is disclosed a method for engaging a member within a soil formation comprising locating a shaft extending between top and bottom ends along a central axis and having at least one auger section therearound and having a first plate, axially rotatably connected to the shaft above a soil formation and rotating the shaft into the soil formation so as to draw the first plate into the soil formation.

The method may further comprise interlocking a second plate rotatably connected to the shaft to an adjacent plate.

Other aspects and features will become apparent to those ordinarily skilled in the art upon review of the following description of specific embodiments in conjunction with the accompanying figures.

BRIEF DESCRIPTION OF THE DRAWINGS

In drawings which illustrate embodiments wherein similar characters of reference denote corresponding parts in each view.

FIG. 6 is a cross sectional view of two soil retaining extensions of

FIG. 5 as taken along the line 5-5 interlocked with each other to form a barrier.

DETAILED DESCRIPTION

Figure 1:
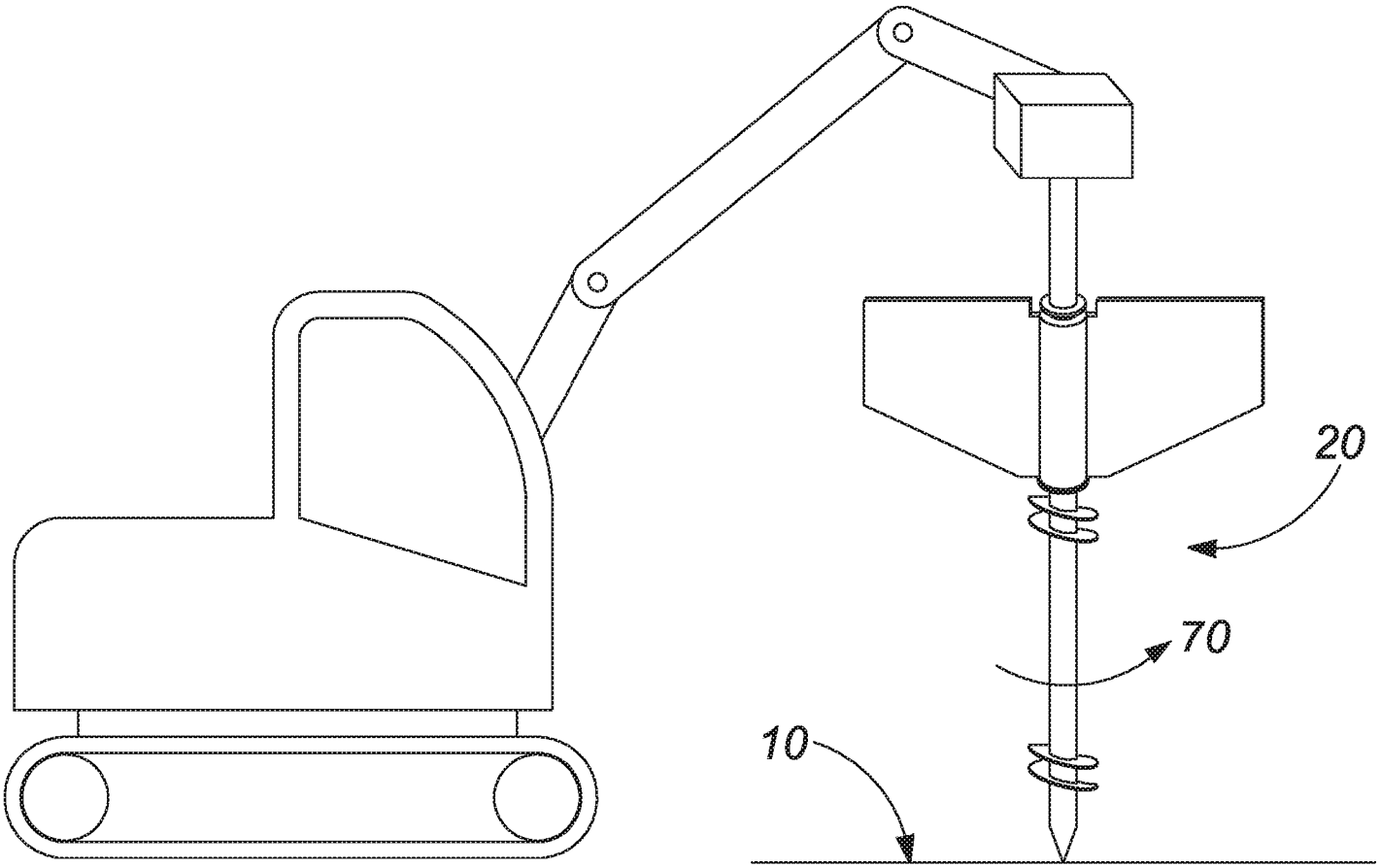
FIG. 1 is an illustration of an excavation site having an apparatus for shoring the excavation located thereabove.
Figure 2:
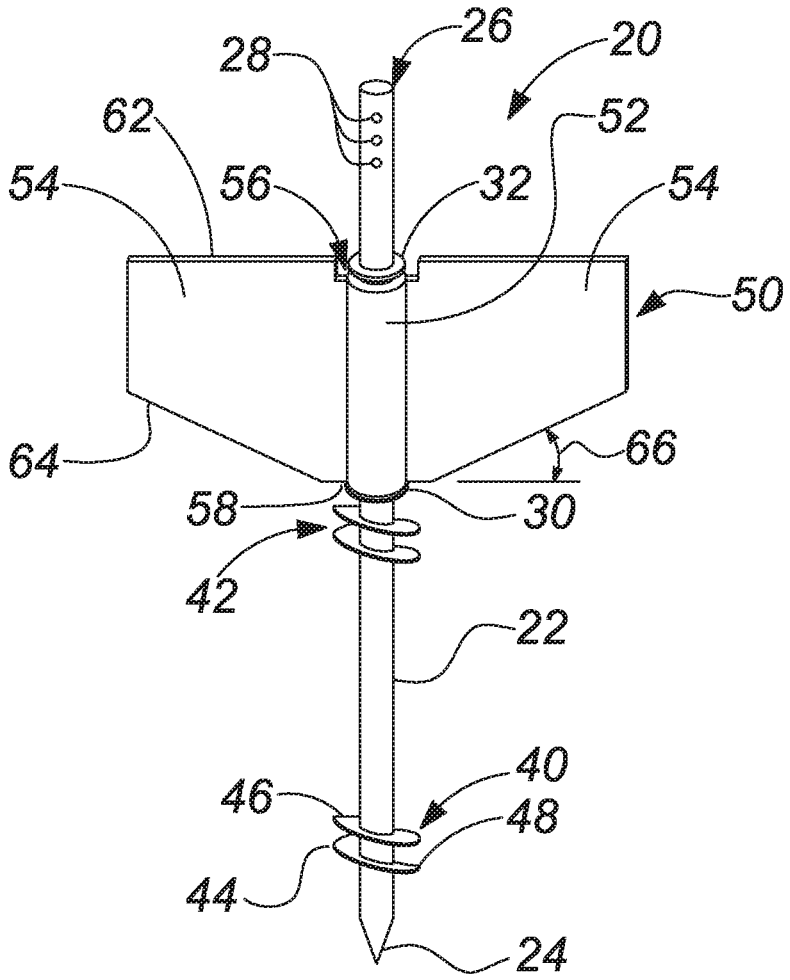
FIG. 2 is a perspective view an apparatus for shoring an excavation site according to a first embodiment of the present invention.

With reference to FIG. 1, an apparatus for engagement within a soil formation 10 according to a first embodiment of the present invention is generally illustrated at 20. The apparatus comprises an elongate shaft 22 having at least one auger 40 extending therearound and a plate 50 rotatably supported at a fixed location therealong. The apparatus 20 is operable to be rotated by a piece of equipment 8, such as, by way of non-limiting example, an excavator, skid steer loader or crane such that the augers 40 and 42 draw the apparatus into the soil formation 10 as will be more fully described below.

The shaft 22 extends between bottom and top ends, 24 and 26, respectively and may have a length of between 12 to 20 feet (3658 and 6096 mm) although it will be appreciated that other lengths may be useful as well. As illustrated, the bottom end 24 of the shaft may be sharpened to ease insertion into a soil formation and the top end may have a plurality of transverse bores 28 therethrough or other suitable means for being gripped by an excavator 8. The shaft 22 includes first and second collars, 30 and 32, respectively. The first and second collars 30 and 32 are spaced apart by a distance sufficient to retain the plate 50 therebetween, such as, by way of non-limiting example between 1 to 16 feet (305 and 3658 mm). The collars 30 and 32 may be secured to the shaft by any suitable means, such as, by way of non-limiting example, fasteners, welding or being formed integrally therewith. The shaft 22 and collars 30 and 32 may be formed of any suitable material, such as, by way of non-limiting example steel, stainless steel or other metals and alloys.

A first auger 40 surrounds the shaft 22 proximate to the bottom end 24 thereof. As illustrated, the apparatus 20 may also include a second auger 42 located thereabove at a position below the plate 50. It will also be appreciated that the first and second augers 40 and 42 may be interconnected with each other to form a continuous auger section extending between the bottom end 24 of the shaft to a location below and proximate to the plate 50. The plate 44 extends substantially radially from the shaft by a distance selected to ensure the auger will draw the apparatus into the soil formation under rotation, such as between 6 and 18 inches (152 and 457 mm) depending upon the soil type for which the apparatus is intended to be used. With reference to the first auger 40, each auger may be formed of a plate 44 of material spirally surrounding the shaft between top and bottom ends, 46 and 48, respectively. The bottom end 48 may optionally be sharpened or tapered to facilitate insertion into the soil formation. Each auger may have a pitch angle selected to draw the apparatus 20 into a soil formation when the shaft is rotated. Each auger 40 or 42 may surround the shaft 22 in as many rotations as is desired by a user, such as, by way of non-limiting example ½ rotation or more. The augers may be formed of any suitable material, such as, by way of non-limiting example steel or stainless steel and may be secured to the shaft in any suitable manner, such as, by way of non-limiting example, welding fasteners or the like.

Figure 3:
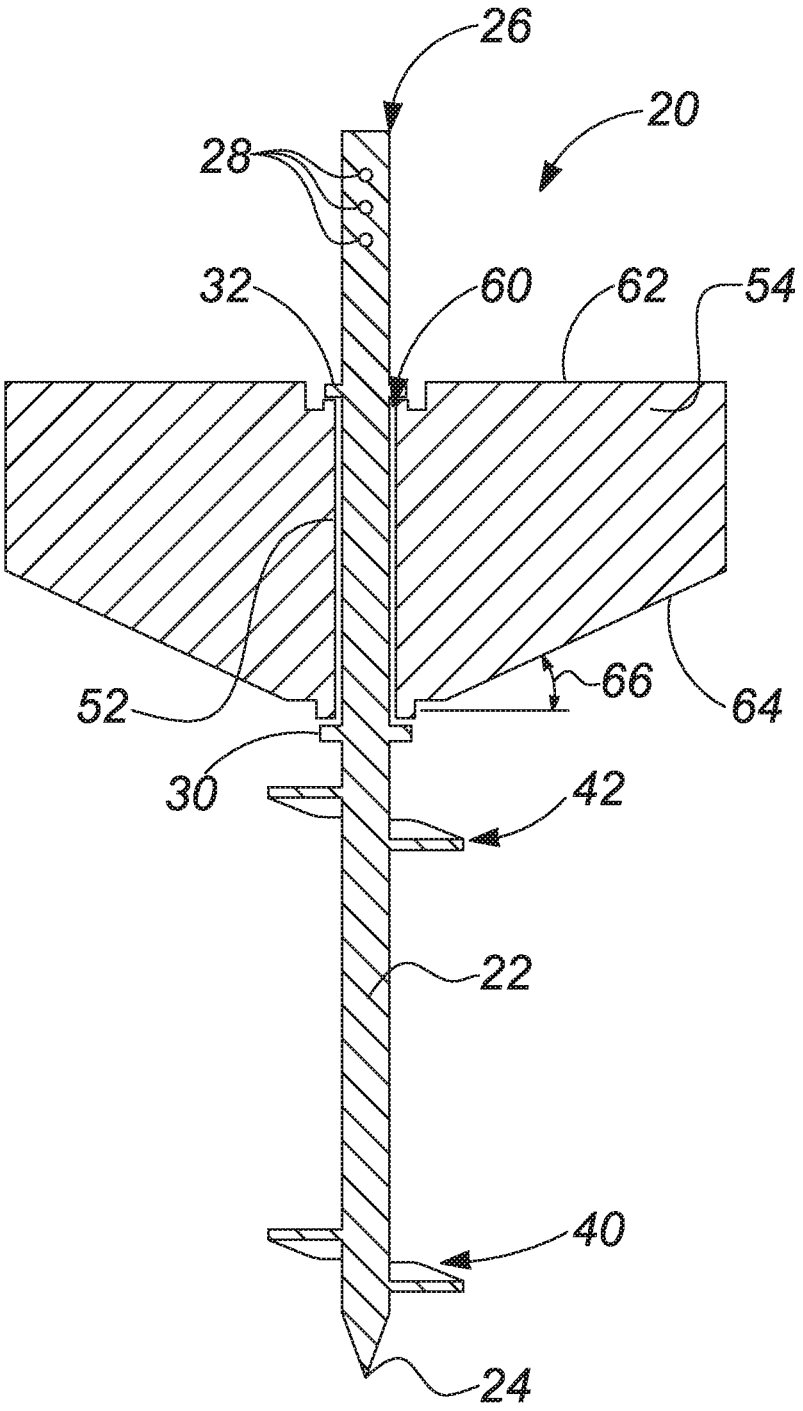
FIG. 3 is a cross sectional view of the apparatus of FIG. 2 as taken along the line 3-3.
Figure 4:
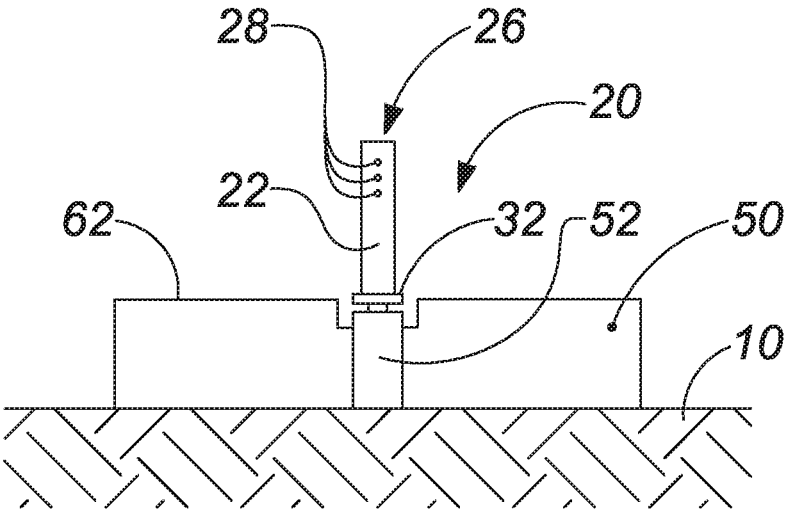
FIG. 4 is a side view of the apparatus of FIG. 2 being inserted into the soil formation.

The plate 50 comprises a central sleeve 52 having a pair of substantially planar members 54 extending radially therefrom. The central sleeve 52 extends between top and bottom ends, 56 and 58, respectively and includes a central bore 60, as illustrated in FIG. 3 sized to rotatably surround the shaft 22. The collars 30 and 32 abut against the top and bottom ends 56 and 58 of the sleeve to retain the sleeve therebetween. Each planar member 54 extends between top and bottom edges, 62, and 64, respectively. The top edges 62 may be substantially perpendicular to the shaft, although other orientations and profile shapes may be useful as well. The bottom edge 64 may be inclined from a plane normal to the shaft by an incline angle, generally indicated at 66. The incline angle 66 facilitates insertion of the plate 50 into the soil formation as the shaft 22 is rotated and may be selected from any angle between 30 and 60 degrees. Optionally, the bottom edge 64 of the planar members 54 may be sharpened or tapered to assist with insertion into the soil formation. The plate may have a height between the top and bottom edges selected to provide a sufficient excavation depth, such as, by way of non-limiting example, between 1 and 6 feet (305 and 1829 mm).

With reference to FIG. 1, in operation, a piece of equipment, such as, by way of non-limiting example, an excavator, skid steer loader or the like, may engage the transverse bores 28 of the apparatus with a rotary auger drive as are commonly known. Thereafter, the apparatus 20 may be located above a soil formation 10 and rotated in a direction generally indicated at 70 so as to engage the augers 40 and 42 into the soil formation. While being rotated, the augers 40 and 42 draws the apparatus into the soil formation until the plate 50 is embedded within the soil formation. Once the plate 50 is embedded to a sufficient depth into the soil formation, the apparatus may be decoupled from the piece of equipment and the soil proximate to the plate may be excavated such that the plate shores excavation site.

Figure 5:
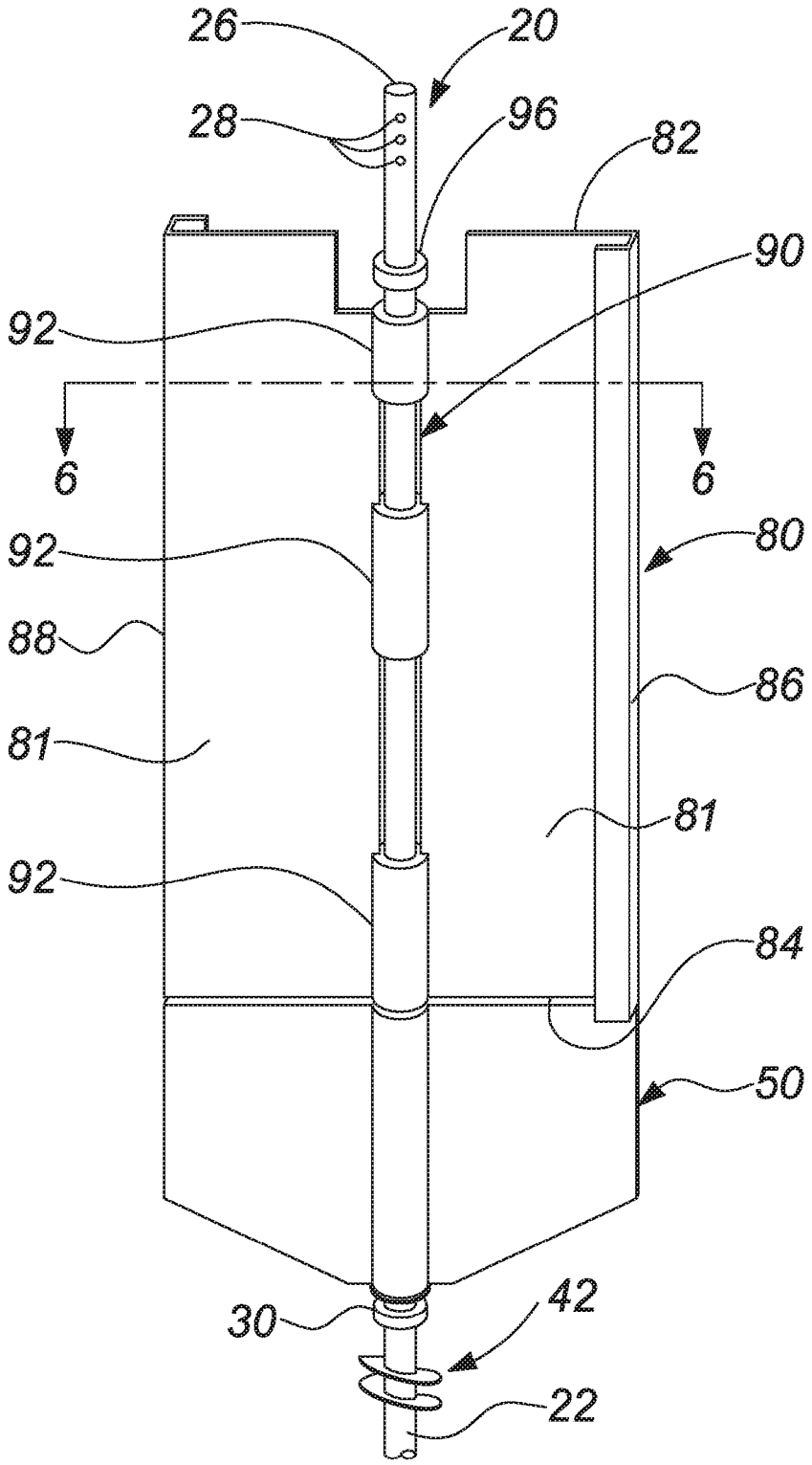
FIG. 5 is a perspective view of the apparatus of FIG. 2 having an optional soil retaining extension.
Figure 6:
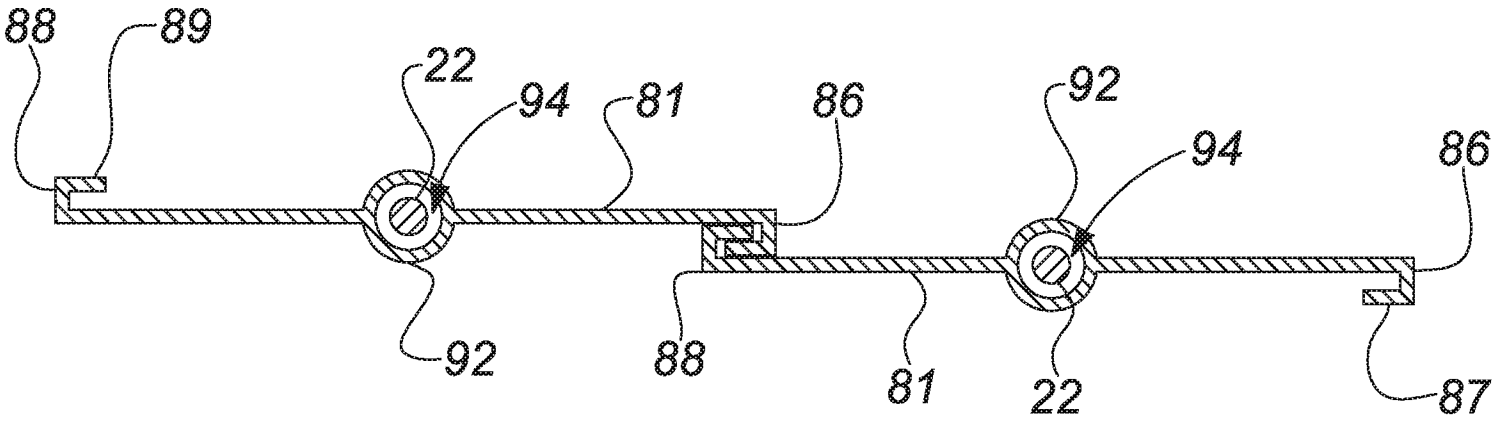

Optionally, the apparatus may include a soil retaining extension 80 as illustrated in FIG. 5. The soil retaining extension 80 may comprise a plate 81 extending between top and bottom ends, 82 and 84, respectively and first and second side edges, 86 and 88, respectively. The plate 81 includes a central bore section 90 having a plurality of sleeves 92 therein having bores 94 therethrough sized to receive the shaft 22 of the apparatus. The bores 94 of the sleeves 92 pivotally retain the soil retaining extension 80 on the shaft 22. With reference to FIG. 6, each of the first and second sides edges includes a return edge lip 87 and 89, respectively. The return edges lips 87 and 89 may be arranged to opposite or the same sides of the plate 81 and are adapted to be interlocked with adjacent return lips of adjacent apparatuses as illustrated in FIG. 6 so as to permit the formation of a continuous barrier. As illustrated in FIG. 5, the soil retaining extension 80 may be retained on the shaft 22 with a collar 96 as will be commonly known. In such embodiments, in operation, the apparatus 20 may be rotated into a soil formation as set out above with the plate 50 below an in planar alignment with the soil retaining extension 80. Thereafter the soil proximate to the soil retaining extension 80 may be excavated with the plate 50 remaining below the depth of the excavation so as to provide additional stability to the shaft 22 and the soil retaining extension.

Figure 7:
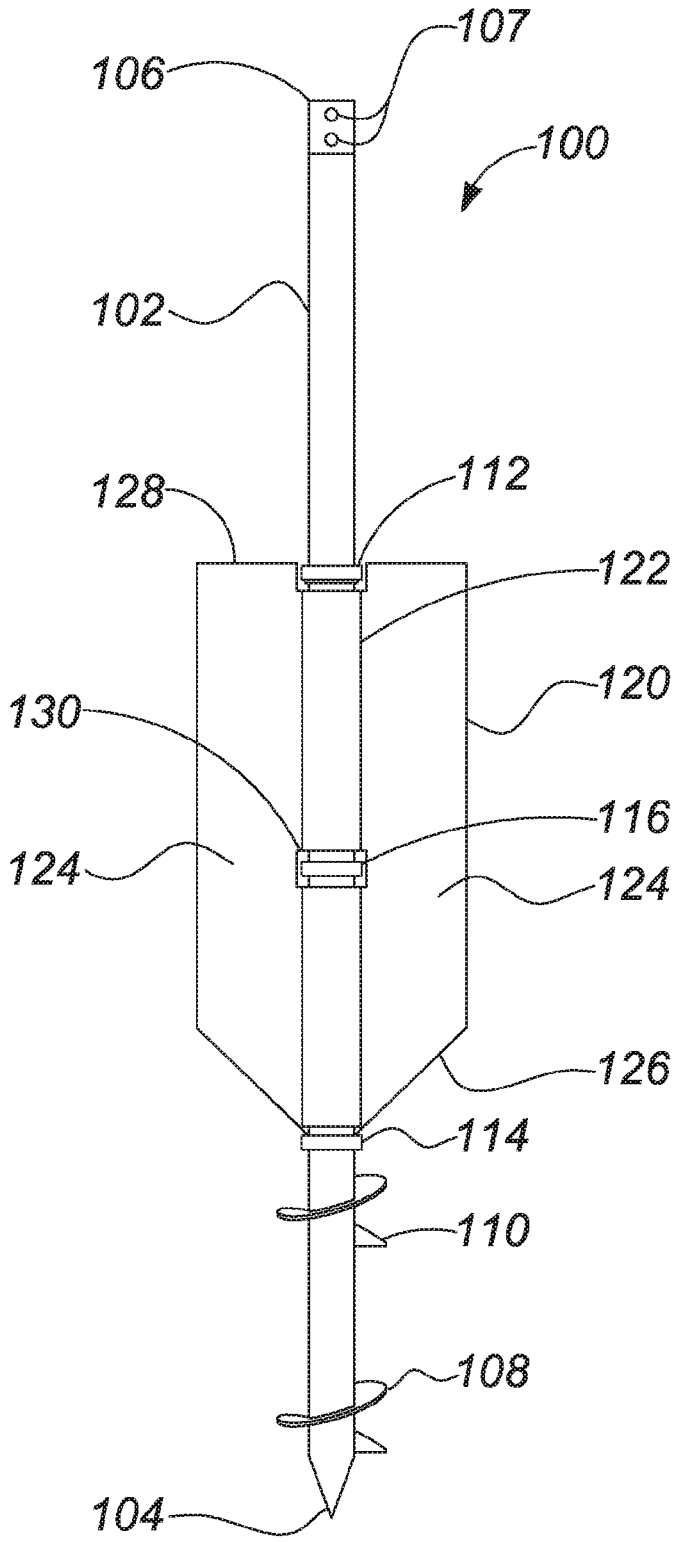
FIG. 7 is a side view of a piling apparatus according to a further embodiment of the present invention.

Turning now to FIG. 7, an alternative embodiment of the present invention is illustrated generally at 100 for use as a screw piling. The screw piling 100 comprises a shaft 102 extending between bottom and top ends, 104 and 106, respectively with a plate 120 rotatably supported therearound. The shaft 102 may have a length of between 6 to 12 feet (1829 and 3658 mm) although it will be appreciated that other lengths may be useful as well. As illustrated, the bottom end 104 of the shaft may be sharpened to ease insertion into a soil formation and the top end may have a plurality of mounting bores 107 for connection to beams, columns or the like as are commonly known. The shaft 102 may also include top and bottom augers 110 and 108 as described above. The shaft 102 includes top and bottom collars, 112 and 114, respectively and an optional middle collar 116. The top and bottom collars 112 and 114 are spaced apart by a distance sufficient to retain the plate 120 therebetween, such as, by way of non-limiting example between 8 to 16 feet (2438 and 3658 mm). The collars 112, 114 and 116 may be secured to the shaft by any suitable means, such as, by way of non-limiting example, fasteners, welding or being formed integrally therewith. The shaft 102 and collars 112, 114 and 116 may be formed of any suitable material, such as, by way of non-limiting example steel, stainless steel or other metals and alloys.

The plate 120 comprises a central sleeve 122 having a pair of substantially planar members 124 extending radially therefrom. The central sleeve 122 extends between top and bottom ends, 128 and 126, respectively and surrounds the shaft 102. The top and bottom collars 112 and 114 abut against the top and bottom ends 128 and 126 of the sleeve to retain the sleeve therebetween. Each planar member 124 extends between top and bottom ends, 128, and 126, respectively. The top end 128 may be substantially perpendicular to the shaft, although other orientations and profile shapes may be useful as well. The bottom edge 126 may be inclined from a plane normal to the shaft by an incline angle as set out above. The planar members 124 and sleeve 122 may include a central opening 130 which is located around the middle collar 116. The planar members 124 extend radially from the plate by a distance sufficient to increase ability of the shaft to resist lateral loads placed thereupon such as, by way of non-limiting example, between 4 and 12 inches (102 and 305 mm). The top end 106 of the shaft 102 may extend above the top end 128 of the plate 120 by a distance sufficient to permit the plate to be embedded below the surface of the soil when the top end 106 of the shaft is proximate to the ground surface. By way of non-limiting example, the top end 106 of the shaft may be up to 6 feet (1829 mm) above the top end 128 of the plate.

While specific embodiments of the invention have been described and illustrated, such embodiments should be considered illustrative of the invention only and not as limiting the invention as construed in accordance with the accompanying claims.

What is claimed is:

1. An apparatus for engaging a soil formation comprising:

a shaft extending between top and bottom ends along a central axis and having at least one auger section therearound;

a first plate, axially rotatably connected to the shaft formed of a planar sheet of material and having a top edge extending perpendicularly from said shaft;

a second plate rotatably connected to said shaft above said first plate formed of a planar sheet of material and having a bottom edge extending perpendiculary from said shaft corresponding to said top edge of said first plate; and first and second collars secured to said shaft with said first and second plates therebetween;

wherein said second plate extends between first and second side edges bent into a u-shaped opening having an orientation towards said shaft so as to be interlocking with adjacent plates.

2. The apparatus of claim 1 wherein said at least one auger section is proximate to said bottom end of said shaft.

3. The apparatus of claim 2 wherein said shaft includes a second auger section located below said first plate.

4. The apparatus of claim 1 wherein said first plate is located proximate to said top end of said shaft.

5. The apparatus of claim 1 wherein said first plate is located at a midpoint of said shaft.

6. The apparatus of claim 1 wherein said first plate is longitudinally located along said shaft.

7. The apparatus of claim 1 wherein said first plate extends radially from said shaft.

8. The apparatus of claim 1 wherein said first plate includes a bottom edge extending at an angle of incline from a plane normal to the axis of the shaft.

9. The apparatus of claim 1 wherein said second plate is alignable with said first plate.

10. The apparatus of claim 9 wherein said second plate is independently rotatable of said first plate.

11. The apparatus of claim 1 wherein said first and second side edges are parallel with said central axis.

12. The apparatus of claim 1 wherein each u-shaped opening comprises a flange extending from each of said first and second side edges to a parallel spaced apart end plate.

13. A method for engaging a member within a soil formation comprising:

locating a shaft extending between top and bottom ends along a central axis and having at least one auger section therearound and having a first plate, axially rotatably connected to the shaft above the soil formation;

providing a second plate rotatably connected to said shaft above said first plate formed of a planar sheet of material and having a bottom edge extending perpendicular from said shaft corresponding to a top edge of said first plate;

providing first and second collars secured to said shaft with said first and second plates therebetween; and rotating said shaft into the soil formation so as to draw said first plate into said soil formation, wherein said first plate is formed of a planar sheet of material and having the top edge extending perpendicularly from said shaft, and wherein said second plate extends between first and second side edges bent into a u-shaped opening having an orientation towards said shaft so as to be interlocking with adjacent plates.

14. The method of claim 13 further comprising interlocking the second plate rotatably connected to said shaft to an adjacent plate.

* * * * *